United States Patent [19]

Pettit et al.

[11] Patent Number: 4,932,695

[45] Date of Patent: Jun. 12, 1990

[54] SUPPORT ARM WITH PASSIVE LOCK SYSTEM

[75] Inventors: Dean A. Pettit; Mary B. Rhodes, both of Owatonna, Minn.

[73] Assignee: Truth Incorporated, Owatonna, Minn.

[21] Appl. No.: 448,257

[22] Filed: Dec. 11, 1989

[51] Int. Cl.[5] ..... E05C 17/30

[52] U.S. Cl. ..... 292/267; 292/338; 292/DIG. 4; 292/DIG. 43

[58] Field of Search ..... 292/DIG. 65, DIG. 4, 292/DIG. 43, 278, 262, 338, 267, 270; 217/60 E

[56] References Cited

U.S. PATENT DOCUMENTS

| | | | |
|---|---|---|---|
| 2,566,182 | 8/1951 | Flynn | 217/60 E |
| 3,000,044 | 9/1961 | Allen et al. | 292/278 X |
| 4,042,266 | 8/1977 | Andenberg et al. | 292/267 |

*Primary Examiner*—Richard E. Moore

*Attorney, Agent, or Firm*—Wood, Phillips, Mason, Recktenwald & VanSanten

[57] ABSTRACT

A support arm for a pivoted window to hold the window open until such time as the locking mechanism for the window is manually released. The support arm has a sequencing latch mounted on one of a pair of sliders that are telescopically mounted relative to each other and a pivoted lock lever is pivoted on the other slider. In moving the sequencing latch to an active latch or lock position, the lock lever is pivoted from an active to an inactive position and is not effective to remove the sequencing latch in response to any movement of the sliders relative to each other until such time as the lock lever is manually moved from the inactive position to an active position wherein, upon relative movement between the sliders, the lock lever can engage and move the sequencing latch from the latch position to an unlatch position.

10 Claims, 3 Drawing Sheets

FIG. 1
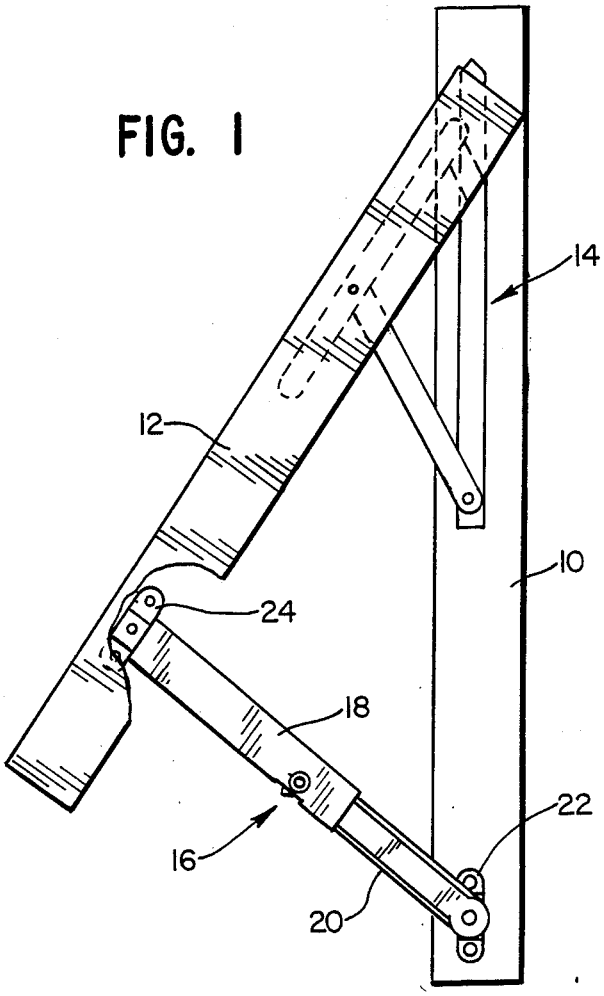
FIG. 2
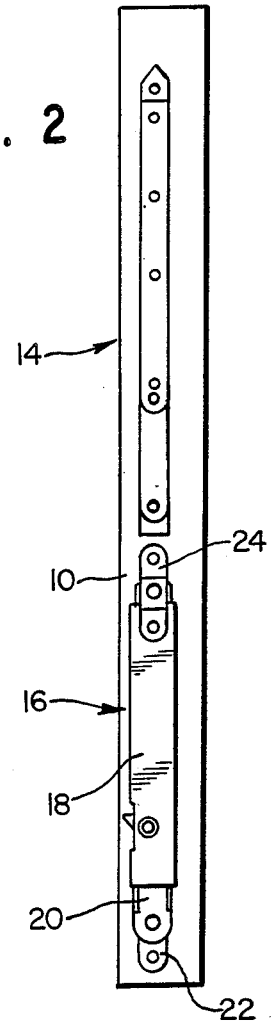
FIG. 3
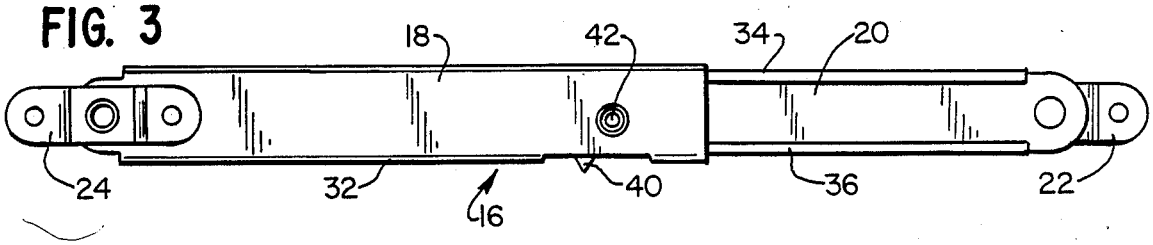
FIG. 4
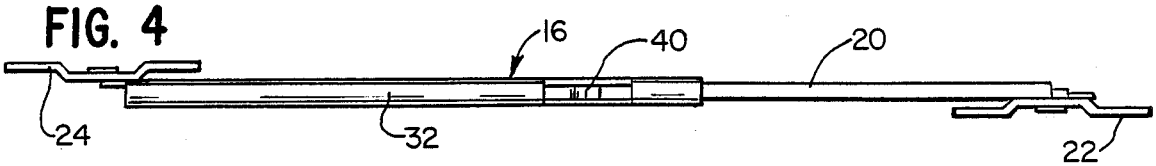
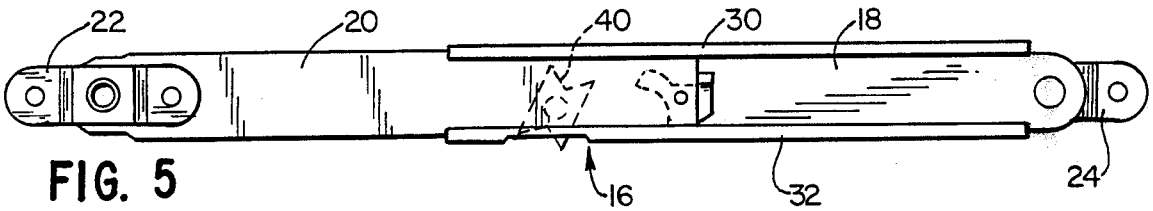
FIG. 5

FIG. 6
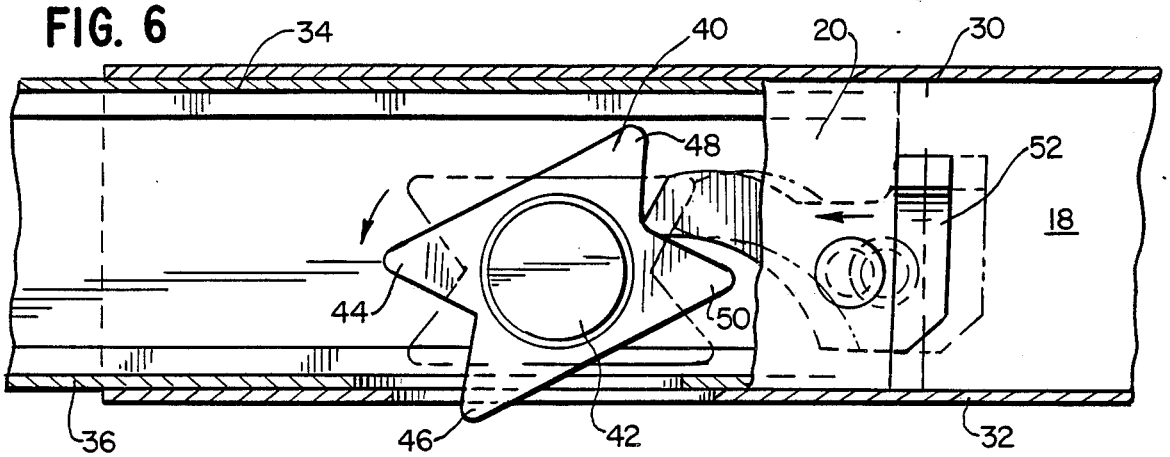
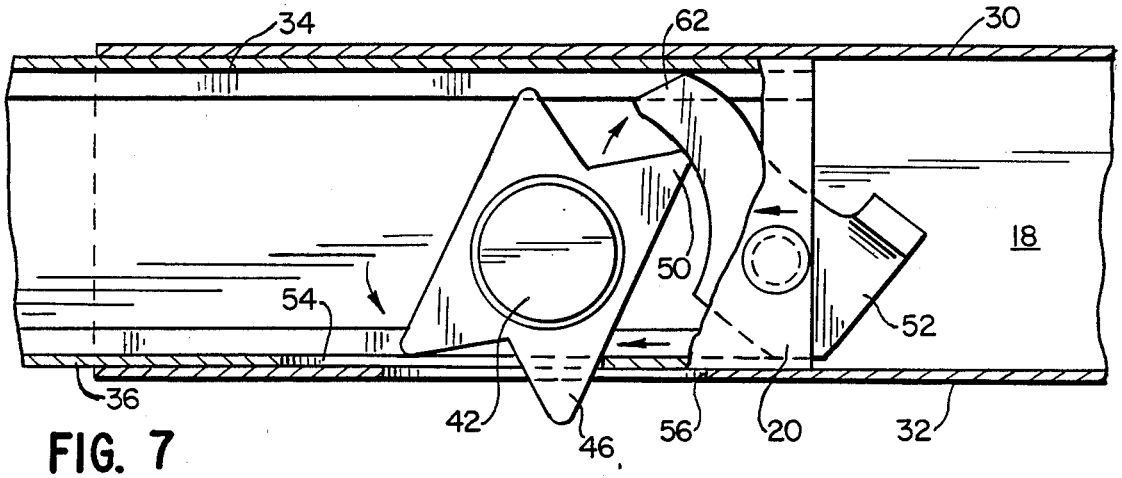
FIG. 7
FIG. 8
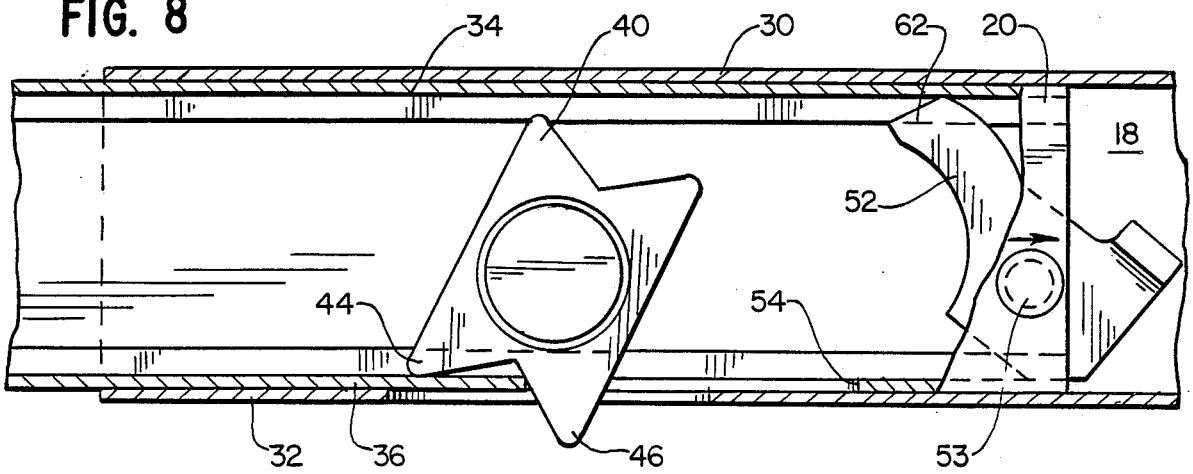

SUPPORT ARM WITH PASSIVE LOCK SYSTEM

FIELD OF THE INVENTION

This invention pertains to a support arm for a window which can be locked in an extended position to hold the window sash fully open and which requires a manual operation to permit closing of the window.

BACKGROUND OF THE INVENTION

A commercially-available support arm has a pair of telescoped sliders and sequential latch structure, generally as shown in the Anderberg et al. U.S. Pat. No. 4,042,266. The Anderberg patent has a sequencing latch which is caused to sequence between a latch position and an unlatched position. This is effected by relative movement between the sliders and contact of the sequencing latch with a stop boss and coaction with the edges of a slot in one of the sliders. Full extension of the sliders relative to each other results in positioning the sequencing latch in a latch position, with a slight retraction of the sliders holding the sequencing latch in latch position. A succeeding full extension of the sliders causes pivoting of the sequencing latch whereby it may move to an unlatched position.

With the structure as shown in the Anderberg et al. patent, it is possible that the sliders of the support arm can be moved to full extended position, as when a strong wind acts on the window sash. As a result, the sequencing latch will be released from latch position for movement to unlatched position whereby the sliders of the support arm can move to a full contracted position enabling the window to slam shut. Because of this, in some areas, a building code has been established that prevents the use of a support arm of the type shown in the Anderberg et al. patent.

SUMMARY OF THE INVENTION

A primary feature of the invention is to provide a support arm for a window which will automatically hold a window sash in open position and which can only be retracted to permit closing of the window by means of a manual operation whereby a strong wind, or other force, cannot release the support arm.

An object of the invention is to provide a new and improved support arm for a window having a pair of telescoped, relatively movable sliders, with a sequencing latch member on one of the sliders and a latch actuator on the other slider, with the latch actuator having an active and inactive position and, in the active position, causing sequencing of the latch in response to relative movement between the sliders and being automatically moved to the inactive position upon full extension of the sliders relative to each other.

Another object of the invention is to provide a support arm as described in the preceding paragraph wherein the latch actuator is a pivoted lock lever and the lock lever has a manually-engageable tab to move the lock lever from inactive to active position when it is desired to sequence the sequencing latch and permit retraction of the sliders.

An additional object of the invention is to provide a support arm comprising, a pair of telescoped relatively movable sliders, a sequencing latch member pivoted on one slider and having a latch position, a latch actuator on the other slider, said latch actuator having an active position for causing pivoting of the sequencing latch member and an inactive position, and means mounting said latch actuator for pivoting from said active position to said inactive position in response to engagement with the latch member and relative movement of the sliders to a fully-extended position.

A further object of the invention is to provide a support arm for a top-hung window having a pair of relatively movable telescoped sliders, said sliders having coacting latch means including a pivoted latch member having a latch position for releasably holding said sliders in an extended position, and a latch actuator having an inactive position to pivot the latch member between latch and unlatched position in response to successive engagements with the latch member, the improvement comprising means mounting the latch actuator for movement to an inactive position in response to movement of the sliders to said extended position.

DESCRIPTION OF THE DRAWINGS

FIG. 1 is an elevational view of a window frame and sash showing the window sash in open position and with part of the window sash broken away;

FIG. 2 is a view similar to FIG. 1 showing a closed window and the window hardware of FIG. 1 with the window sash removed;

FIG. 3 is a bottom plan view of the support arm shown in extended lock position;

FIG. 4 is a side elevational view thereof;

FIG. 5 is a top plan view of the support arm shown in extended lock position and reversed from the position shown in FIG. 3;

FIG. 6 is a fragmentary view of the support arm on an enlarged scale showing the lock mechanism preparatory to the sequencing latch being in latch position and with one slider broken away;

FIG. 7 is a view similar to FIG. 6 showing the support arm fully extended and the sequencing latch in a latch position;

FIG. 8 is a view similar to FIG. 7 showing the support arm less than fully extended and with the sequencing latch locked in latch position;

DESCRIPTION OF THE PREFERRED EMBODIMENT

Figure 9:
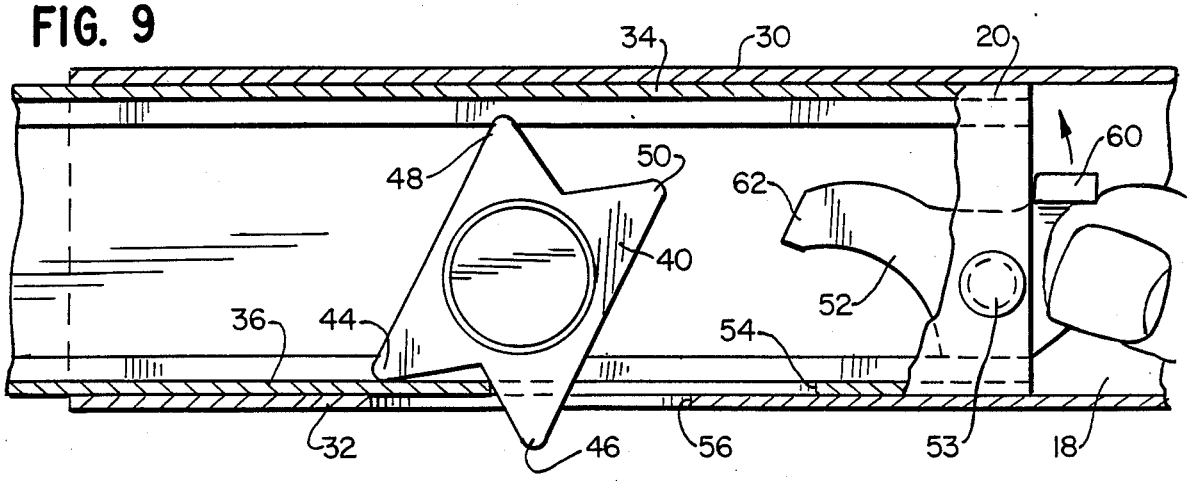
FIG. 9 is a view similar to FIG. 8 showing the pivoted lock lever manually-operated to latch-releasing position.

The support arm with passive lock system is shown in association with a top-hung window in FIGS. 1 and 2 wherein a window frame 10 movably mounts a window sash by means of window hinge structure, indicated generally at 14. The support arm is indicated generally 16 and has a pair of telescoped, relatively movable sliders 18 and 20 which, as seen in FIG. 1, are almost fully extended to hold the window sash 12 open.

The support arm 16 has a pair of pivoted mounting brackets pivotally mounted one to each of the sliders. A pivoted mounting bracket 22 is pivoted to an end of the slider 20 for attachment to the window frame and a pivoted bracket 24 is pivoted to an end of the slider 18 for attachment to the window sash.

As seen in the general views of FIGS. 1 to 5, the support arm sliders 18 and 20 are generally U-shape, with spaced-apart side walls, with the slider 18 having the side walls 30 and 32 and the slider 20 having the side walls 34 and 36.

The two sliders are assembled in sliding, telescoped relation to define a chamber therebetween which houses a sequencing latch 40. The sequencing latch 40 is pivotally mounted to and adjacent an end of the slider 18 by means of a rivet 42 and is spaced from the base of the slider by means of a washer (not shown) to permit unrestrained rotation of the sequencing latch. The sequencing latch 40 has opposite ends formed with a V-shape, terminating in pairs of prongs 44, 46, 48 and 50. The sequencing latch 40 has an unlatched position shown in broken line in FIG. 6 and also shown in FIG. 11, and a latch position which locks the sliders in a substantially extended position, as shown in FIG. 8.

The sequencing latch is caused to rotate in response to relative movement between the sliders by means of a latch actuator which is shown as a pivoted lock lever 52. The pivoted lock lever 52 is pivoted to slider 20 adjacent an end thereof by a pivot pin 53 and is movable between an active position, as shown in FIG. 9, and in full line in FIG. 6 and an inactive position, as shown in FIGS. 7 and 8.

In the active position of the pivoted lock lever 52, the lock lever can act on the sequencing latch 40 similarly to the action of the fixed stop boss 12 in the Anderberg et al. patent. With the lock lever 52 being pivoted, as compared to the fixed stop boss 12 in the Anderberg et al. patent, the lock lever can move to an inactive position which assures that the sequencing latch will not be rotated to an unlatched position when a force, such as that exerted by strong wind, acts on the window sash to fully extend the support arm.

As the telescoped sliders 18 and 20 are moved to extend the support arm, the pivoted lock lever 52, which is shown in FIG. 6 in broken line position, approaches the sequencing latch 40 and contacts the sequencing latch in the broken line position in the Figure. Further extending movement of the sliders moves the pivoted lock lever 52 to the full line position and rotates the sequencing latch 40 slightly in a counterclockwise direction, as indicated by the arrow, to the full line position of FIG. 6.

Full extension of the sliders causes a reaction between the sequencing latch 40 and the pivoted lock lever, as seen in FIG. 7, wherein the sequencing latch prong 50 engages an arcuate surface of the pivoted lock lever and pivots the lock lever to a full inactive position. In this position, an end of the lock lever abuts side wall 34 of the slider 20 and the prong 46 of the sequencing latch extends out through a slot 54 in the side wall 36 of the slider 20 and a slot 56 in the side wall 32 of the slider 18 to be in a latch position.

A slight retraction of the sliders relative to each other shifts the slot 54 of the slider 20 to the right, as viewed in FIG. 8, wherein a part of the slider wall 36 engages with the prong 44 of the sequencing latch to prevent further counterclockwise movement of the sequencing latch and hold it in latch position. This prevents retraction of the support arm.

When the window is to be closed, the pivoted lock lever 52 is moved from the inactive position, shown in FIG. 8, to the active position, shown in FIG. 9, by manually engaging a tab 60 on the lock lever and pivoting the lock lever counterclockwise, as indicated by the arrow in FIG. 9. Thereafter, the sliders 18 and 20 are fully extended, which moves the wall 36 of the slider 20 out of engagement with the prong 44 of the sequencing latch and brings the pivoted lock lever end 62 into engagement with the sequencing latch. Initial engagement is shown in broken line in FIG. 10. With full extension of the sliders relative to each other, the prong 46 of the sequencing latch comes into contact with an end of the slot 54 in the wall of the slider 20 to limit counterclockwise pivoting of the sequencing latch and there has been slight clockwise pivoting of the lock lever 52 to the full line position shown in FIG. 10.

Figure 10:
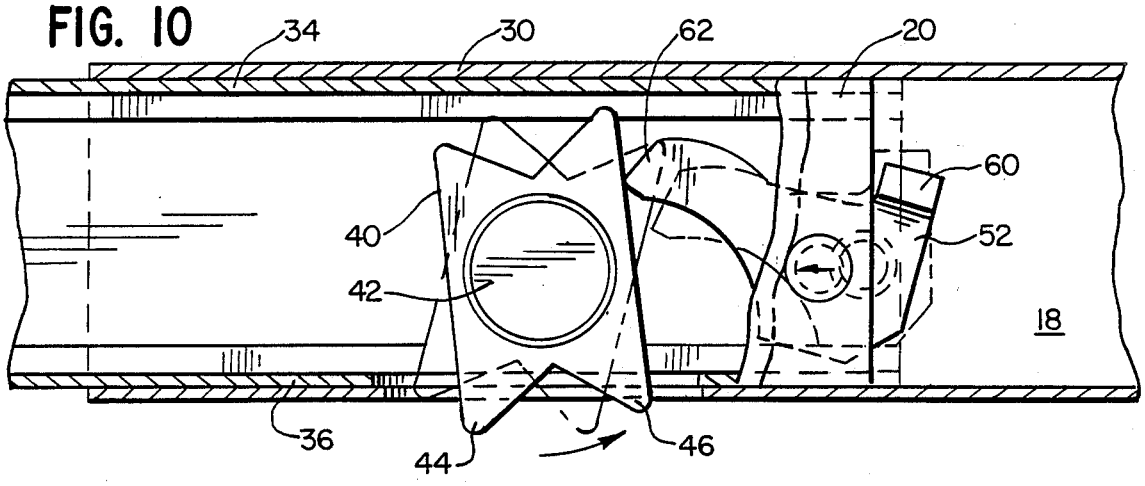
FIG. 10 is a view similar to FIG. 9 showing the pivoted lock lever in broken line in initial engaging position with the sequencing latch and with both the sequencing latch and pivoted lock lever in full line after the latch member has been released.
Figure 11:
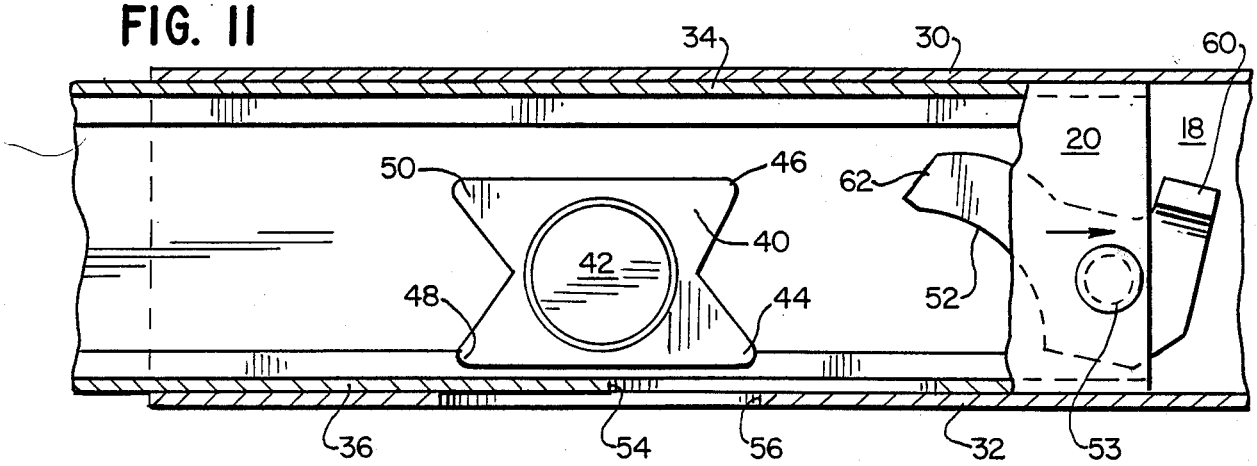
FIG 11 is a view similar to FIG. 10 showing the sequencing latch in unlatched position.

As the sliders contract to shorten the support arm as the window closes, slot 54 of the slider wall 36 has an edge engage the sequencing latch 40 and pivot the sequencing latch counterclockwise from the full line position of FIG. 10 to the position shown in FIG. 11 wherein the sequencing latch is in unlatched position.

As will be evident the pivoted lock lever enables automatic locking of the support arm in position to hold the window open and a manual operation, namely, pivoting of the lock lever 52 from the inactive position of FIG. 8 to the active position of FIG. 9, is required to release the latch mechanism so that the support arm can be retracted.

We claim:

1. A support arm comprising, a pair of telescoped relatively movable sliders, a sequencing latch member pivoted on one slider and having a latch position, a latch actuator on the other slider, said latch actuator having an active position for causing pivoting of the sequencing latch member and an inactive position, and means mounting said latch actuator for pivoting from said active position to said inactive position in response to engagement with the latch member and relative movement of the sliders to a fully-extended position.

2. A support arm as defined in claim 1 wherein said latch actuator is a pivoted lock lever.

3. A support arm comprising, a pair of relatively movable telescoped sliders with each slider having a generally U-shape cross-section with spaced-apart side walls, a sequencing latch member pivoted on one slider, an opening in a side wall of each of said sliders through which the latch member may extend when in a latch position, a lock lever on the other of said sliders, said lock lever having active and inactive positions, said lock lever in active position functioning to pivot the latch member between latch and unlatch positions on successive engagements thereof in response to successive extension of said sliders, said lock lever being pivoted on said other slider at a location wherein full extension of said sliders will cause the latch member to pivot the lock lever to said inactive position.

4. A support arm as defined in claim 3 including a manually-engageable tab on said lock lever for moving the lock lever from inactive to active position.

5. A support arm for a top-hung window having a pair of relatively movable telescoped sliders, said sliders having coacting latch means including a pivoted latch member having a latch position for releasably holding said sliders in an extended position, and a latch actuator having an inactive position to pivot the latch member between latch and unlatched position in response to successive engagements with the latch member, the improvement comprising means mounting the latch actuator for movement to an inactive position in response to movement of the sliders to said extended position.

6. A support arm as defined in claim 5 wherein said latch actuator is a pivoted lock lever.

7. A support arm as defined in claim 6 wherein the pivoted latch member is on one slider and the pivoted lock lever is on the other slider.

8. A support arm as defined in claim 7 wherein said latch member is pivoted intermediate its ends and has a pair of prongs at opposite ends thereof with a generally V-shape notch between a pair of prongs, and said lock lever having two positions, said lock lever in a first position having an end positionable within a notch to cause pivoting of the latch member to the latch position and pivoting of the lock lever to a second position as the sliders are moved to fully-extended position.

9. A support arm as defined in claim 8 wherein said lock lever is pivoted adjacent an end of said other slider, and an engageable tab on said lock lever beyond an end of said other slider for moving said lock lever from said second position to said first position.

10. A support arm for a pivoted window comprising a pair of telescopically-interfitted sliders with each slider having means at one end for connection to one of either a window sash or a window jamb, a latch member pivotally-mounted on one of said sliders adjacent an end remote from said one end for movement between retracted and latch positions, a lock lever pivotally-mounted on the other of said sliders adjacent an end remote from said one end of the other slider, said lock lever having a first position for engagement with the latch member to pivot the latch member from retracted to latch position as the sliders are moved to a fully-extended position with said lock lever simultaneously pivoting to a second position, said lock lever in said second position being located to not pivot the latch member upon contact therebetween.

* * * * *

UNITED STATES PATENT AND TRADEMARK OFFICE

CERTIFICATE OF CORRECTION

PATENT NO. : 4,932,695

DATED : June 12, 1990

INVENTOR(S) : Dean A. Pettit and Mary B. Rhodes

It is certified that error appears in the above-indentified patent and that said Letters Patent is hereby corrected as shown below:

Column 2, line 11, change "inactive" to --active--.

Column 4, line 62, change "inactive" to --active--.

Signed and Sealed this

Thirteenth Day of September, 1994

*Attest:*

Bruce Lehman

BRUCE LEHMAN

*Attesting Officer*

*Commissioner of Patents and Trademarks*